United States Patent [19]

Harmsen

[11] 4,266,720

[45] May 12, 1981

[54] RAIL FASTENER

[75] Inventor: John L. Harmsen, Vienna, Va.

[73] Assignee: Stedef S.A., Saint-Cloud, France

[21] Appl. No.: 105,856

[22] Filed: Dec. 20, 1979

[51] Int. Cl.[3] ..... E01B 9/30

[52] U.S. Cl. ..... 238/349

[58] Field of Search ..... 238/349, 283, 310, 338, 238/340, 342, 343, 350

[56] References Cited

U.S. PATENT DOCUMENTS

| | | | |
|---|---|---|---|
| 1,603,163 | 10/1926 | Steele | 238/349 |
| 1,863,248 | 6/1932 | McGrew | 238/349 |
| 3,796,369 | 3/1974 | Faville | 238/349 |
| 4,054,247 | 10/1977 | Duchemin | 238/349 |

*Primary Examiner*—Richard A. Bertsch

*Attorney, Agent, or Firm*—Breneman, Kane & Georges

[57] ABSTRACT

A resilient rail clip or fastener formed in a generally trapezoidal configuration from springsteel is provided for securing rail track to railroad ties that may be constructed from a variety of materials. The trapezoidal shaped resilient rail clip has a long edge for gripping the rail which when untensioned forms a type of sine shaped curve and which when tensioned to the rail, utilizing two spikes or screws per clip, transforms the sine shaped curve into a linear line that is biased flat against the foot of the rail. The pressure of the two spikes or screws per clip in combination with the configuration of the springsteel dampen potentially harmful acceleration and deacceleration forces in the rail and frequency vibrations in the range of 800 to 1000 Hz which occur prior to and during train passage by absorbing and dissipating the forces while preventing lateral movement, creep, rotation and failure of the rail by utilizing the natural frequencies of the novel clip while minimizing track maintenance by reducing deterioration of the rail tie.

16 Claims, 7 Drawing Figures

RAIL FASTENER

BACKGROUND OF THE INVENTION

1. Field of the Invention

The present invention pertains to a resilient rail fastener of a novel configuration formed from springsteel for securing rails to cross ties utilizing two spikes or screws per rail clip that provides an exceptionally effective clamping force while dampening and distributing acceleration and vibrational forces resulting from load conditions during train passage. More particularly, the invention relates to the application of a springsteel rail clip of a trapezoidal configuration having a novel sine shaped curve along the rail biasing edge which is flattened when fully tightened against the foot of the rail. The novel configuration of the clip along with its springsteel construction functions to dampen accelerational forces and vibrational frequencies of the rail in the range of from 800 to 1000 Hz that have heretofore caused deterioration and a reduction of the useful life of rail ties. The utilization of the two spikes or screws per clip allows each bolt to provide about 1,500 lbs. of pressure to secure the rail to the tie while allowing the rail clip to dissipate shock and imact vibrations that would otherwise impair the integrity of the rail spike.

2. Description of the Prior Art

The prior art includes a variety of devices which illustrate a myriad of rail clips and fastening systems for fastening rails to a rail tie. The effectiveness of the combination of rail clip and spike or screw depends not only upon the traffic conditions but also the type of railroad tie, the number of spikes or screws per rail clip and the configuration of the rail clip which functions to absorb impact and transfer of load to the substrate rail tie. In addition to the vertical forces and vibrations acting upon the rail tie and clip, there are high lateral forces which in combination with the vertical forces produce stresses and strains on the rail fastening system which primarily includes the rail tie, the rail clip and the spikes or screws. Heavy axle loads, unit trains of long lengths and load uniformity and higher operating speeds subject the rails to high lateral forces along with acceleration forces which result in rotation of the rails and rail spreading. The accelerational and vibrational forces promote fatigue in the wood or concrete tie which together with the effect of the environment and aging, significantly account for high maintenance and derailments in the railroad industry.

The prior art pertaining to rail fastening systems in the United States focuses primarily uppon wooden ties and a steel tie plate which utilizes two spikes on opposite sides of the rail base for each tie plate. The steel tie plates used in the United States include four spike holes for securing the rail to the tie plate and tie, but which in practice employ only two spikes. The combination of vibrations of high frequency and dynamic impact upon the conventional rail spike results in deterioration of wooden ties by cracking and splintering the wood surrounding the rail spike resulting in the rail spike loosing contact with the rail base. As is all too well known to those skilled in the art, spikes have to be periodically tightened by work crews and sometimes the rail tie must also be replaced where the tie has splintered or otherwise deteriorated in use. This deterioration of the securement between the rail and rail tie is generally attributable to the high frequency vibrations and dynamic impact from acceleration and deacceleration forces which cause the heads of the spike to project a considerable distance above the railbase and result in the rail losing its stability followed by rail spread which in many cases leads to derailments.

Representative of the prior art utilizing wood fastening systems is U.S. Pat. No. 2,218,156 which provides a resilient clip for dampening vertical forces which is apparently used in combination with wooden ties. This patent illustrates a two bolt per clip arrangement (FIG. 4) but does not longitudinally dampen vibrations and forces and can be overtightened which would exceed the elastic limit of the springsteel. The rail fastening clip as illustrated in U.S. Pat. No. 1,798,357 is of a general trapezoidal configuration, but which in function and operation is different from the rail clip of the present invention. In U.S. Pat. No. 1,798,357, the resilient rail clip is biased against the rail with the short end of the trapezoidal rail clip against the rail base with the long edge of the trapezoidal configured rail clip biased against the edge of the rail. This rail clip is then rendered compatible with the traditional two spike tie plate utilized in the United States by the utilization of a clip in combination with the plate spring. The rail fastening system of U.S. Pat. No. 1,798,357 is considerably different from the present invention, since it not only employs a U-shaped (FIG. 13) rather than sine shaped curve, but also utilizes spikes at a different point and combines a number of elements that do not correspond to the clip of the present invention.

Many of the prior art rail clips utilized in European rail systems employ a concrete rail tie and provide a resilient clip to absorb much of the forces that the wooden ties absorb in the United States rail systems. In the European systems a single screwpike is utilized along with a resilient rail clip and elastomer rail pad to absorb vibrations between the concrete and metal screws which would otherwise cause cracking of the concrete. Such clips have generally not been utilized in United States rail systems because of the incompatibility of the single rail screw to the United States two spike system. In addition, the rail clip having single screwpikes, such as illustrated in U.S. Pat. No. 4,054,247, is not amenable to a side by side disposition or a double bolt application where the dynamic forces upon the rail dictate additional securement.

The configuration of the prior art rail clip, as depicted in U.S. Pat. No. 3,796,369, is similar in some respects to the present rail clip. However, unlike the present invention, U.S. Pat. No. 3,796,369 utilizes a single rail screw for concrete rail ties and does not use the sinusoidal curved edge to bias the rail base or foot. Furthermore, in use the sinusoidal curved portion in its stressed condition (FIG. 3) is not completely flattened. The present invention while employing a sinusoidal curve stresses the sinusoidal curve to completely flatten the curve along the length of the rail base.

The prior art rail clips have generally been designed to dampen only one of the two forces encountered in the passage of train loads over the rail tie. One such prior art system which has been traditionally employed in the United States utilizes a single spike on each side of the rail base and secures the rail to the tie with a force of only about 2,500 lbs. The European prior art systems which have generally employed a resilient clip and a single screwpike per clip to fasten the rail to the tie provides a force of about 4,500 lbs. In addition, many of these prior art systems utilize clips which may be overtightened resulting in damage and decreased efficiency of the fastening system. The present invention, however, cannot result in damage to the rail clip by overtightening and is compatible with either the United States or European rail systems by accomodating either two screwpikes or the two traditional spikes per clip to fasten the rail to the rail tie utilizing a force of 1,500 lbs. per spike or 3,000 lbs. per rail clip resulting in a total force of 6,000 lbs. or about 1,500 lbs. force greater than the prior art systems.

The configuration of the novel rail clip of the present invention even more importantly allows both lateral and vertical forces to be dampened along the entire length of the rail clip and is particularly effective in absorbing and dampening vibration frequencies in the range of 800 to 1000 Hz. which is the natural frequency of the rail and which has been particularly damaging to rail fastening systems.

SUMMARY OF THE INVENTION

The disadvantages and limitations of prior art rail fastening systems including the problem of compatability of resilient rail clips to the wood and spike system used in the United States and the problem of deleterious frequency vibrations which cause removal of the rail spike, splintering and cracking of wood and concrete ties may be obviated by the utilization of rail clips constructed in accordance with the present invention. The novel rail clip functions to absorb and dissipate vibrations and maintains the lateral position of the rail with respect to the rail tie. The present rail clip is compatible with either the standard American tie plate having two spike holes on each side of the foot of the rail or the threaded rail spikes for wooden or concrete rail ties. The rail clip furthermore provides a firmer lock between the rail and the rail tie by allowing greater forces to be exerted upon the clip and rail without exceeding the elastic limit of the clip or the subsequent ability of the novel clip to dissipate vibrational and accelerational forces along the length and in the configuration of the rail clip.

The present rail clip is formed from springsteel in a generally trapezoidal shape in which the short end of the trapezoidal shaped springsteel clip is curved at an angle of about 90° to the plane of the trapezoidal shaped body to form a support foot. The long side of the trapezoidal shaped rail clip is of a sinusoidal shape in its untightened configuration which is tightened flat against the foot or base of the rail. In use, the sinusoidal shaped long edge cooperates with the springsteel support foot to dampen and absorb vibrations that would otherwise be directly transmitted to the rail tie through the spike or screwpike. The sinusoidal configuration of the long edge of the clip terminates in two slightly flattened ends to assist in the firm engagement of the base of the rail to hold it in place as load is transferred from the rail to the rail tie upon the passage of traffic.

The long sinusoidal shaped edge of the trapezoidal shaped clip is installed to engage the base of the rail in such a manner that when the two spikes or pikes are driven into the rail tie, the sinusoidal shaped springsteel of the long side of the clip gradually deforms and makes a three point contact consisting of the ends and center of the sinusoidal shaped clip. The tightening of the clip is continued until all points along the long side of the clip are in flat contact with the foot of the rail. At this point, about 3,000 lbs. of force is exerted by the novel rail clip against the foot of the rail with each bolt or spike accounting for about 1,500 lbs. of force. As a result the springsteel clip should be formed from material having the ability to be completely deformed along the base of the rail upon the application of about 1,500 to 10,000 lbs. and preferably in the range of about 2,000 to 4,000 lbs. upon the surface of the novel clip. In addition, a second clip may be placed adjacent to the first clip on the opposite base of the rail to provide an additional 3,000 lb. force for securing the base of the rail to the rail tie.

The novel configuration of the present rail clip assures that the clip is not overstressed or the elastic limits of the springsteel are exceeded during installation which could result in permanent deformation with a consequent loss of efficiency of the rail clip. The resilient characteristics of the novel rail clip when biased flat against the foot of the rail is such that vibrational forces upon the approach of the train and accelerational and deaccelerational forces that accompany the transfer of load from the rail to the rail tie upon the passage of trains and vehicles is such that a wide range of vibrations and accelerational forces are absorbed by the resiliency of the clip in combination with an elastomer support pad. The sinusoidal configuration of the springsteel rail clip in conjunction with the support foot of the novel rail clip and the disposition of the two rail spikes or screwpikes result in the absorption and dampening of those forces that might otherwise cause damage to the rail tie or disturb the integrity of the connection between the rail and the rail tie by the rail spike or screw.

In modern railway equipment and tracks, rails are generally welded together in long continuous sections. In order to avoid undesirable concentrations of stresses in the rail, it is important that the rail is firmly attached to each cross tie so as to reduce or eliminate the possiblity of developing creep or migration of the rail relative to the rail tie. The present invention is particularly adept in maintaining the integrity of the clamping force between the rail and rail tie as a result of the distribution of forces between the two bolts per clip to provide greater clamping force along with the downward sloping end of the long edge of the novel clip to restrain rail migration.

The dampening of vibrational and acceleration forces by the resiliency of the springsteel clip results in a longer service life of the components and a reduced maintenance of the fastening system for the entire system of track. The double spike or screw arrangement on each side of the rail base not only increases the stability of the rail, but also the resistance against rotation of the rail is practically doubled along with an increase in the resistance of the rail to lateral spreading. The novel rail clip further may be utilized in both wood and concrete tie applications to improve operational safety since even if one spike or screwpike should loosen or fail, the second one is available as a backup unit.

These features of the invention reduce the amount of track maintenance and provide greater clamping force for the clip resulting in reduced strain and forces on the wood fibers in timber ties and the structural integrity of concrete ties. Moreover, as a consequence of its design and construction, the novel clip of the invention is conveniently manufactured from springsteel and reduces maintenance problems and promotes safety by reducing track spreading and migration.

DESCRIPTION OF THE DRAWINGS

Other advantages of the invention will become apparent to those skilled in the art from the following detailed description of the invention in conjunction with the accompanying drawings in which.

DETAILED DESCRIPTION OF THE INVENTION

Figure 1:
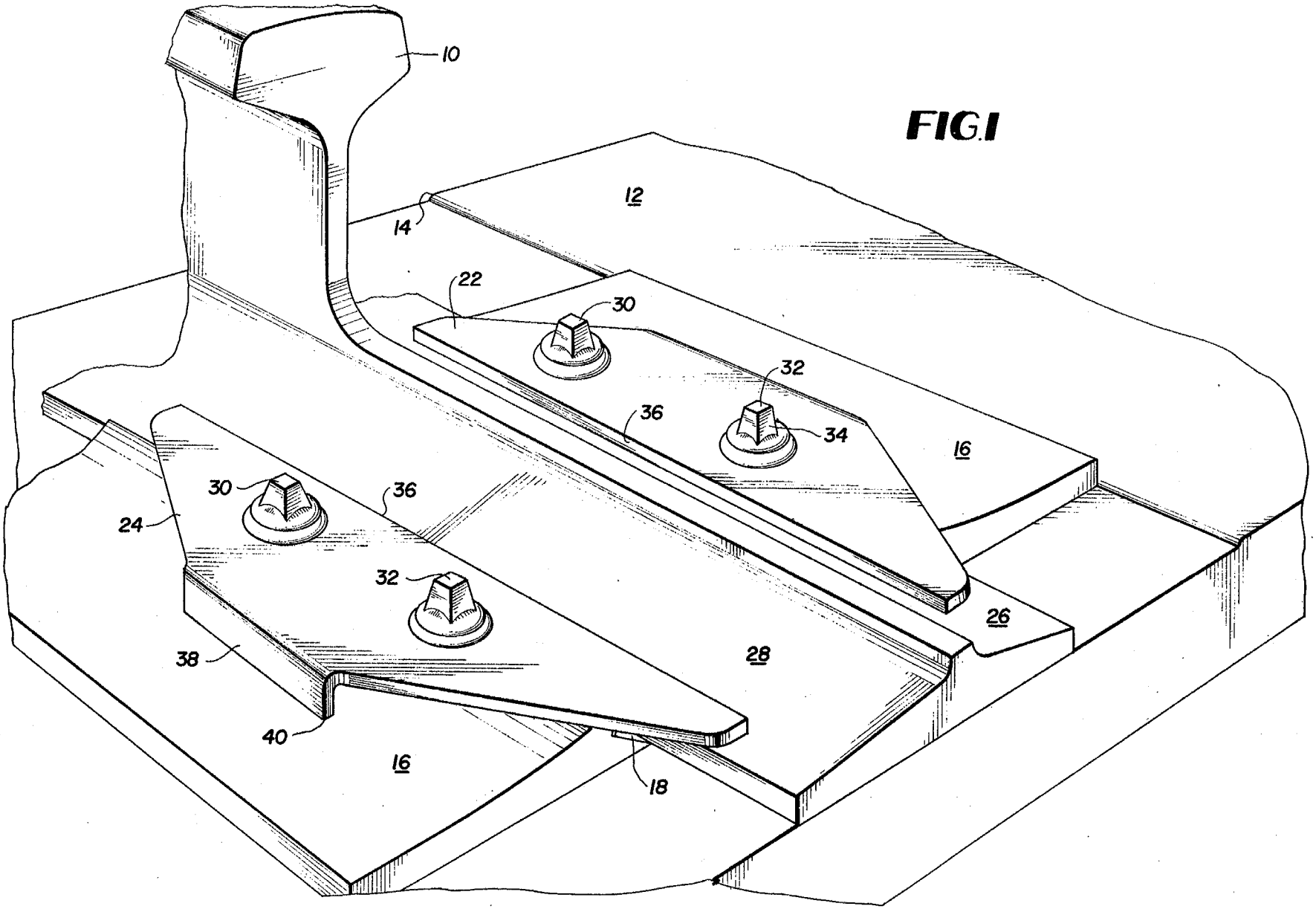
FIG. 1 is a side elevational view of two trapezoidal shaped rail clips engaging adjacent portions of the base of a partially cut away rail.

Referring now to FIG. 1, a rail 10 has been partially cut away to illustrate the securement of the rail to a rail tie 12 with a pair of springsteel rail clips 22 and 24. In most applications in the United States, the rail tie 12 is composed of wood although the rail clip of the present invention is effective for the securement of rails to either wood, concrete or other forms of rail ties. The rail tie 12 forms a support for the rail in a manner which is well known to those skilled in the art and includes a flattened portion 14 for receiving a steel rail tie plate 16. Generally in such applications, it is preferable to interpose a resilient elastomer pad 18 between the rail and the tie plate 16. In more modern systems, the utilization of an elastomer pad assists in prolonging the life of the rail tie system by reducing rail vibrations to assist in maintaining the integrity of the rail fastening system. Rail 10 is placed on pad 18 in tie plate 16 and a pair of novel rail clips 22 and 24 are employed to firmly secure the rail 10 in tie plate 16 and to the rail tie 12.

Rail clips 22 and 24 are designed to securely engage the base 26 and 28 of rail 10 by utilizing two rail spikes or screwpikes 30 and 32 per each rail clip. These screws or spikes may be of the variety that is depicted in FIG. 1 having a bolt shaped head 34 to assist in the securement of the rail 10 to the tie 12 by the tensioning of the pair of novel rail clips to the tie 12. As will be recognized from FIG. 1, the long edges 36 of the trapezoidal shaped rail clips 22 and 24 are in their operative embodiment designed to lie flat against foot 26 and 28 of the rail 10. The entire length of edge 36 is designed to rest flat against rail in which the force of the screws 30 and 32 are distributed laterally along the length of edge 36 which is also supported by curved portion 38 which terminates in a flat support foot 40 which may be designed to be supported by either tie plate 16 or rail tie 12.

Figure 3:
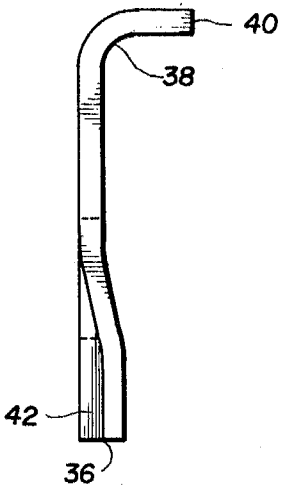
FIG. 3 is a side elevational view of the rail clip of FIG. 2.
Figure 2:
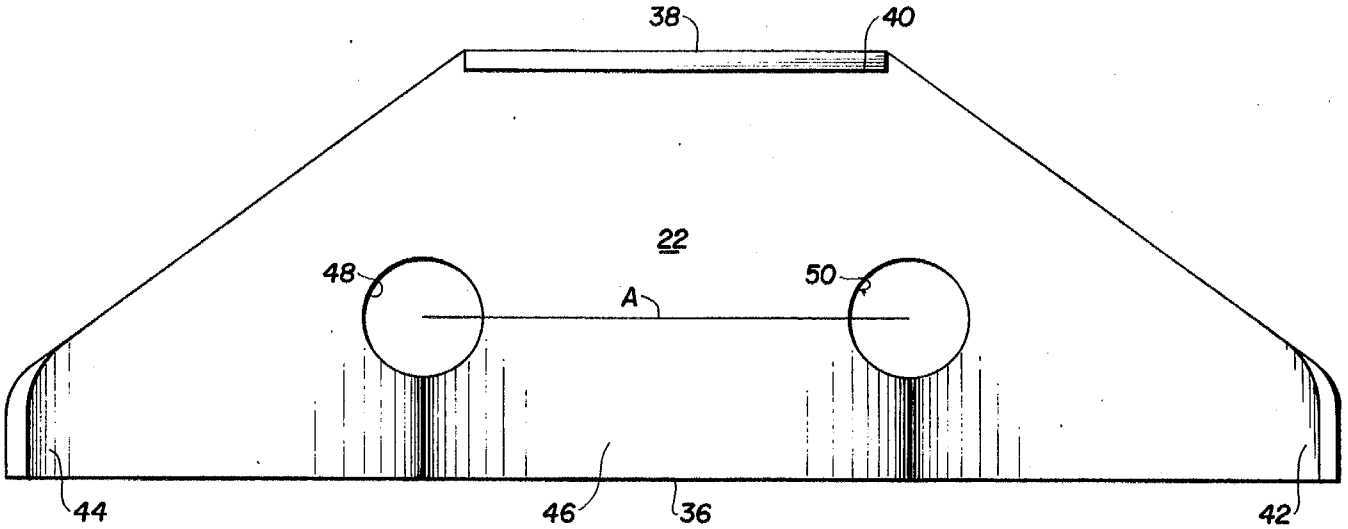
FIG. 2 is a bottom plan view of a rail clip in an unstressed condition.
Figure 4:
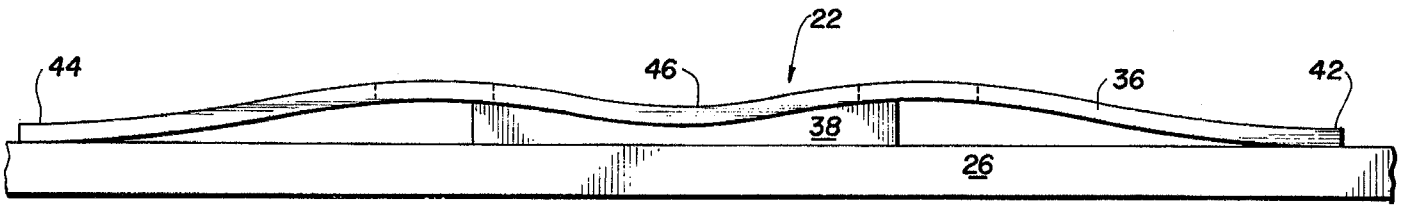
FIG. 4 is a side elevational view of the unstressed novel rail clip of FIG. 2 positioned on the base of a rail.

Referring now to FIGS. 2, 3 and 4, the configuration of the novel rail clip is illustrated in an unstressed condition. The generally trapezoidal shaped rail clip as viewed from the bottom includes a long edge 36 which terminates in two downwardly projecting ends 42 and 44 as is best illustrated in FIG. 4. At or near the center 46 of the long edge 36, the surface projects downwardly to form a generally sinusoidal shaped curve along the length of edge 36. The downwardly projecting center 46 projects rearwardly toward foot 40 to intersect a point at or about even to an imaginary centerline A (FIG. 2) drawn between the holes 48 and 50 in rail clip 22.

Figure 5:
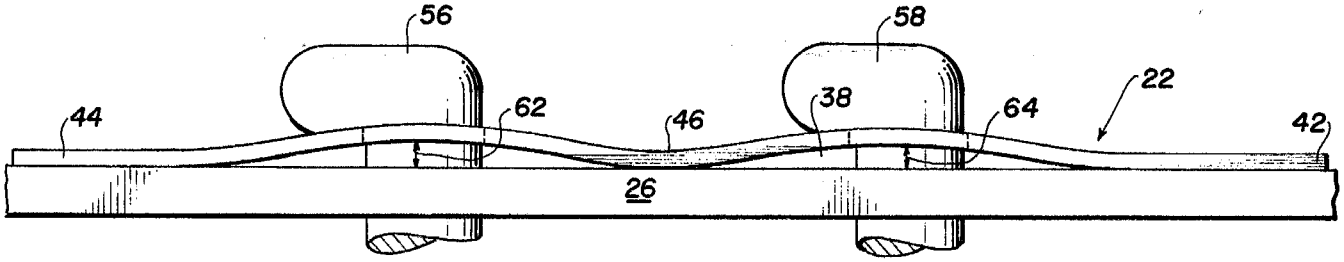
FIG. 5 is a side elevational view similar to FIG. 2 in which the novel rail clip is in a partially stressed condition.

In installation, the novel rail clip is placed against base 26 and in an unstressed condition, ends 42 and 44 are in contact with the base 26. As is illustrated in FIG. 4, two screwpikes or railspikes 56 and 58 are then placed in position and driven into the tie to fasten the rail to the rail tie. The sinusoidal edge 36 of the novel rail clip is deformed in installation so that when spikes or screws 56 and 58 are torqued down or hammered into the rail tie the springsteel of the rail clip gradually deforms so that center 46 is the sinusoidal shaped curve comes in contact with the foot of the rail 26 in a manner as is illustrated in FIG. 5 to provide a three point contact along the length of rail foot 26. These points of contact are identified in FIG. 5 as points 42, 44 and 46.

The tightening of the screws or spikes 56 and 58 is continued until the springsteel in the sinusoidal shaped edge 36 is completely flattened against the base of the rail 26. At this point the entire length of the clip is evenly supported on the foot of the rail so that it is not possible to overstress and exceed the elastic limit of the springsteel material which could result in a permanent deformation of the clip. The size of the gaps as represented by arrows 62 and 64 (FIG. 5) is such that the elastic limit of the springsteel is not exceeded when the gap is completely closed and edge 36 is completely flattened along the length of base 26 of the rail 10.

The rail fastening system of the present invention not only allows the force of the tightening of the novel clip to be dissipated along the length of the foot 26 on the rail 10, but also functions to absorb vibrational and impact forces upon train passage. The dissipation of force along the length of edge 36 along with the novel sinusoidal configuration of the rail clip allows the rail clip to absorb and dampen vibration that would otherwise be transmitted from the rail to the screwpike and into the tie and thereby weaken the fastening strength of the screw or spike to the rail tie. Deterioration of a fastening of the railspike or screw generally appears as cracks where a concrete rail tie 12 is utilized or the splintering of the rail tie 12 where the rail tie 12 is composed of wood. The novel configuration of the present rail clip allows these vibrations to be absorbed by the rail clip 22 by the utilization of its configuration along with its springsteel composition.

Figure 6:
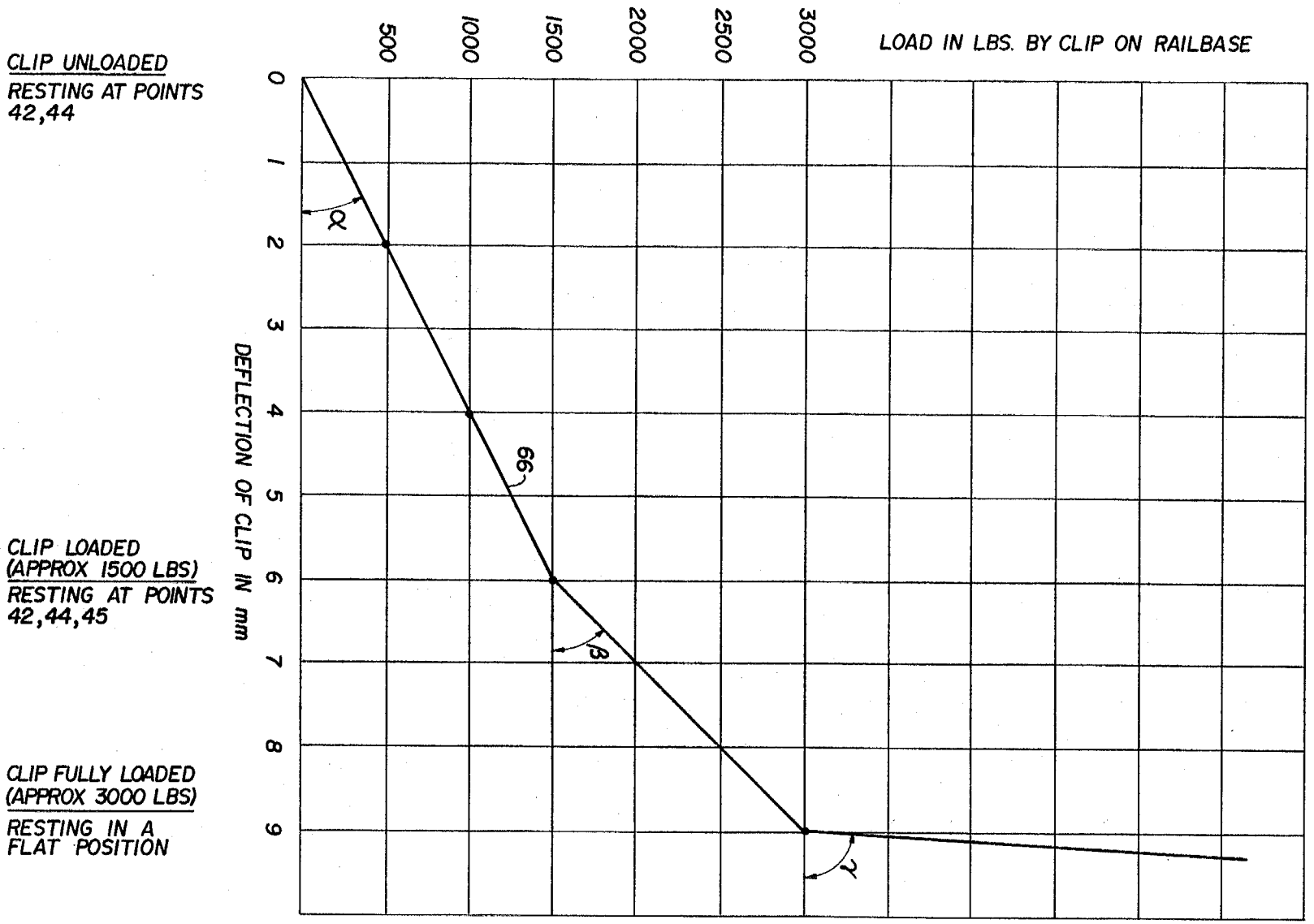
FIG. 6 is a graph illustrating the stressing of the novel rail clip in which deflection of the rail clip is a function of load.

The loading of the novel clip is illustrated graphically in FIG. 6 by line 66 which indicates deflection in millimeters of the novel clip in comparison with the load placed on the rail by the two spikes or screws utilized to fasten the clip against the base of the rail 26. As has heretofore been discussed, the novel rail clip is placed against the base of the rail in an untensioned condition wherein ends 42 and 44 rest against the rail base 26 (FIG. 4). The position $\alpha$ (FIG. 6) represents the untensioned clip along with the subsequent deformation and load in pounds as the screws or spikes are driven into the rail tie. At a load of about 1,500 lbs. and a deflection of the clip of about 6 millimeters, center 46 contacts the rail base 26 (FIG. 5) which is represented in FIG. 6 by the angle $\beta$. At this point approximately 750 lbs. pressure is placed on each screw or spike to result in the contact of center 46 with the railbase. Additional load is placed on the novel rail clip until the entire edge 36 is in linear or flat contact with the base of the rail 26 (FIG. 1). This linear contact is represented by angle $\gamma$ in which each spike or pike provides about 1,500 lbs. load on the clip and a deflection of about 9 millimeters to evenly distribute the fastening force along the surface of the rail base 16. The angles of $\alpha$, $\beta$ and $\gamma$ represent the rate of elasticity of the novel clip in its various stages of deflection.

A second rail clip is placed adjacent to the first rail clip, as is illustrated in FIG. 1, and two screws or spikes are utilized similarly to fasten the second rail clip against the opposite base 28 of rail 10. In a like manner, each screw or spike on the second rail clip applies about 1,500 lbs. force in flattening edge 36 against base 26 to provide a total rail fastening force of about 6,000 lbs. per rail at the rail tie 12. The utilization of the two spikes or screws per clip along with the novel configuration of the rail clip provides superior lateral stability of the rail which is particularly useful in curved sections of track. This advantage of the present invention results in part from the different resilient characteristics of the three contact points as represented by angles $\alpha$, $\beta$ and $\gamma$ which accomodate a wide range of vibrational and accelerational forces that are transmitted to the rail during the approach and passage of trains. The present invention is consequently particularly adapted to modern railway track where the rails are welded in long continuous strings in which the novel rail clip functions to prevent creep in the rail relative to rail tie while improving lateral stability and reducing the tension per screw and spike while providing a greater clamping force per rail clip for both timber and concrete rail ties. The double bolt arrangement per clip not only increases the stability of the rail but also practically doubles the resistance of the rail against rotational and lateral spreading.

Figure 7:
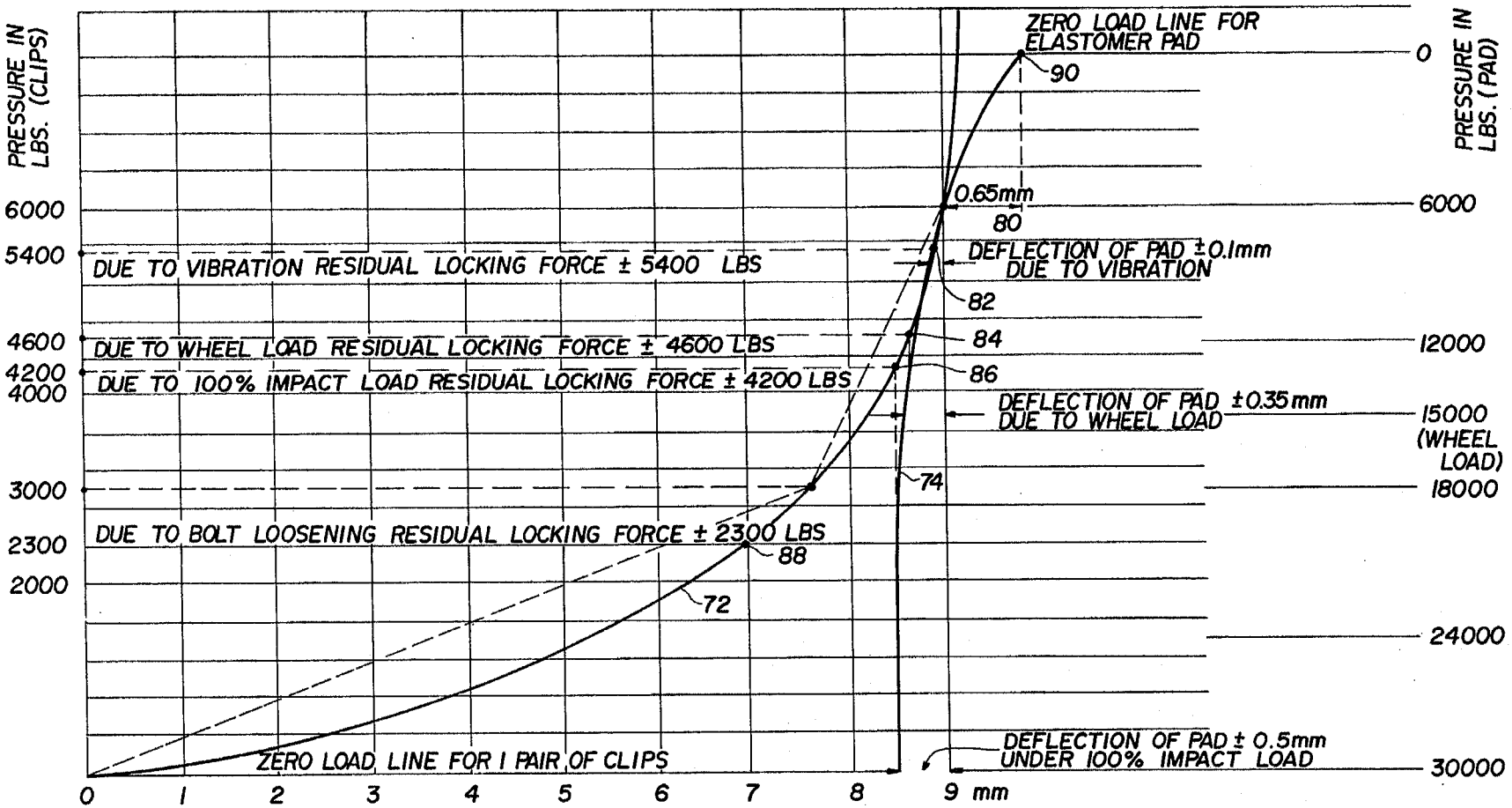
FIG. 7 is a graph illustrating the operation of the novel rail clip in absorbing and dampening vibrational and accelerational forces by the passage of a train and the transfer of load by the action of the configuration and the springsteel composition of the rail clip.

Referring now to FIG. 7, curve 72 illustrates the composite clamping force of two rail clips secured to each base of a rail 10 as illustrated in FIG. 1. This curve represents the elasticity of the pair of clips and substrate elastomer pad 18 (FIG. 1) that have been completely tightened against the rail and illustrates the amount of deflection in millimeters at various pressure pound loadings upon the novel rail clip. The millimeter deflection scale is identical for both the clips and the pad. The total composite deflection of both the rail clip and the pad is about 9.65 millimeters as is depicted by point 80 in FIG. 7. Of the total 9.65 millimeter deflection about 0.65 millimeters is due to the amount of deflection of the elastomer pad. The elastomer pad in combination with the novel rail clip cooperates to dampen the vibrations and acceleration and deacceleration forces. Curve 74 represents the deflection of the elastomer pad as a result of the transfer of the clamping force of the clip, vibrational and wheel load forces on the rail which in combination with the deflection of the rail clip provides a total deflection of about 9.65 millimeters.

The approach and passage of trains upon the rail tie and its effect upon the rail elastomer pad, rail clip and spike or screw fasteners are best illustrated in FIG. 7 by reading the pressure scale at the far right of the FIG. 7 that illustrates typical vibrational and acceleration forces. The millimeter scale for the deformation of the clips and the pads have been maintained for both the clamping force on the rail and the vibrational and acceleration forces on the rail during train passage which accounts for the two different pressure scales. The left hand pressure scale illustrates the pressure in pounds for the clip, while the right hand side depicts the pressure in pounds upon the approach and transfer of loads.

The total amount of deflection for both the pad and the novel resilient rail clip before and during train passage is illustrated by line 72 with line 74 illustrating that amount of the total which is directly resultant from the passage and dampening of loads. The deflection of the elastomer pad as represented by line 74 is compensated by the elastic deforming of the novel rail clip. The total force exerted by the two rail clips on a single rail at the rail tie is 6,000 lbs. as illustrated by point 80 in FIG. 7. The approach of a train first causes vibrations in the rail and provides a small deflection of the elastomer pad of about 0.1 millimeters as a result of a vibrational force in the range of 800 to 1,000 Hz. These vibrations are dampened by the elastomer pad in cooperation with the novel resilient clip. The vibrational deflection in the pad and clip is illustrated as point 82 in FIG. 7 and represents the forces of acceleration of the rail where the force or pressure is less than 12,000 lbs. These vibrational forces result in an elastomer pad deflection of about 0.1 millimeters and produces a corresponding residual fore in the clip of about 5,400 lbs.

The wheel load transmission of force to the rail clip, elastomer pad and rail tie occurs in the range of about 10,000 to 15,000 lbs. at which point the novel springsteel rail clip absorbs much of the impact and vibrational forces. The amount of deflection resulting from the passage of the wheel load is about 0.35 millimeters in the elastomer pad and about 0.35 millimeter deflection and frequency vibration being directly absorbed by the novel rail clip. At the transfer of load to the rail tie, the residual locking force of about 4,600 lbs. is maintained as is represented by point 84. In instances where there is 100% impact for a double wheel load on the rail, there is a deflection of about 0.5 millimeters of the elastomer pad and rail clip with a corresponding residual force in the clip of about 4,200 lbs. is represented by point 86 in FIG. 7. Point 88 on FIG. 7 represents the possibility of loosening all of the bolts by 2 millimeters with the passage of the wheel load on the rail which still results in a residual force of 2,300 lbs. on the rail to maintain the rail in a safe condition.

As will be recognized, the natural frequency of rail vibration in the 1000 Hz. range causes the pad deflection of about 0.1 millimeters but maintains the locking force of the novel clip at about 5,400 lbs. Normal wheel load causes a deflection of the elastomer pad of about 0.35 millimeters which still result in a locking force in the novel rail clip of about 4,600 lbs. Even where the impact is about 30,000 lbs. the pad deflection is about 0.5 millimeters with the locking force of the rail clip remaining at about 4,200 lbs. which is more than sufficient to properly maintain even long sections of welded rail. The curve 74 from point 80 to point 90 represents at point 90 the elastomer pad without the load force provided by the novel rail clip. The curve from point 90 to point 80 represents at point 80 the total deflection of the elastomer pad resulting from the clamping force of the novel rail clip.

The novel rail clip of the present invention provides greater operating safety by employing two screws or spikes arrangement which is compatible with both wooden ties employed in most rail systems in the United States and concrete ties. In addition to the safety factor, the screws or spikes and novel rail clips reduce the possibility of fatigue in the wood and maintenance on the track to provide a superior fastening system which maintains the integrity of the rail in relation to the rail tie. Furthermore, even if one screw or spike should be loosened or fails, the second screw or spike is available to function as a backup unit in much the same manner as an ordinary single screw or spike until repairs can be made to the underlying rail tie.

The novel design provides a reduced strain on the bolts and timber fibers since only 50% of the tightening force per screw or spike is required to apply a superior clamping force that is more evenly distributed along the length of the rail base and novel rail clip to result in a reduction in failures and rail track maintenance. The formation of the edge of the rail clip in a sinusoidal configuration provides a clip that cannot be overstressed while providing improved longitudinal restraint of the rail that is important in applications utilizing a continuously welded rail. This configuration also dampens vibrations prior to, during and after passage of trains, while also evening out the forces of acceleration and deacceleration on the passage of load forces which otherwise work prior art screws and spikes loose from the wood and also result in a reduction of the service life of the rail tie. Moreover, as a consequence of its design and construction, the novel rail clip is easier to manufacture, reduces maintenance and derailments caused by track spreading and rail migrations.

As will be recognized by those skilled in the art, the present invention has a wide range of applicability to various types of rail and rail ties formed of concrete, wood and other materials by providing a superior fastening system for maintaining the integrity of the rail to the rail tie. The invention may be implemented in a varity of ways utilizing the novel sinusoidal shape springsteel edge for engaging and dissipating forces along the length of the base of the rail while alleviating and dampening the deleterious effects of vibration and acceleration upon the substrate rail tie by distributing these forces between the sinusoidal edge and support foot of the novel rail clip. It will be further appreciated that the present invention may be implemented in a variety of ways to suit the particular application of the rail to rail tie for example, with or without the use of the traditional tie plate. Consequently, it is intended that these and other modifications and applications of the invention to a variety of systems may be made within the spirit and scope of the invention as defined in the following claims.

What is claimed is:

1. A rail fastening clip for securing a rail to a rail tie having the capacity to dampen and distribute load and vibrations along the contact surface between the rail and clip and through the area of the clip comprising a generally trapezoidal shaped springsteel clip having a long edge for engaging the foot of the rail, said long edge having an arched sinusoidal configuration which when installed by flattening the sinusoidal configuration against the foot of a rail subsequently dampens high frequency vibrations by engaging said foot of said rail with the ends and center of said long edge and dampens low frequency vibrations by engaging said foot of said rail with said ends, said trapezoidal shaped springsteel clip having a short edge, said short edge curved to terminate in a support foot disposed at an angle of about 90° to said trapezoidal shaped clip.

2. The rail fastening clip for securing a rail to a rail tie of claim 1, wherein said sinusoidal configuration of sald long edge formed from said springsteel is flattened by applying a total pressure of about 1,500 pounds to 10,000 pounds.

3. The rail fastening clip for securing a rail to a rail tie of claim 1 further comprising two holes for fastening said clip to a rail and rail tie.

4. The rail fastening clip for securing a rail to a rail tie of claim 3, wherein said holes are disposed adjacent to arched portions of said sinusoidal shaped long edge.

5. The rail fastening clip for securing a rail to a rail tie of claim 4, wherein said sinusoidal shaped long edge terminates in two downwardly projecting ends, said downwardly projecting ends project to a point lower than the middle portion of said sinusoidal shaped long edge.

6. The rail fastening clip for securing rail to a rail tie of claim 4, wherein said springsteel is flattened by applying a total pressure of about 2,000 to 4,000 pounds to said arched portions of said sinusoidal shaped long edge.

7. A rail clip for fastening rail to rail ties comprising a springsteel plate having a long edge and a short edge wherein said short edge is curved at an angle of about 90° to said springsteel plate to form a support foot and said long edge forms a double arched sine shaped curve and wherein said double arched sine shaped curve of said long edge is flattened against the foot of a rail by applying a total pressure of about 1,500 pounds to 10,000 pounds to said double arched sine shaped curve and which upon train passage dampens high frequency vibrations by engaging said foot of said rail with the ends and center of said double arched sine shaped curve and which dampens low frequency vibrations by engaging said foot of said rail with said ends to form a single arched sine shaped curve.

8. The rail clip for fastening rail to rail ties of claim 7, wherein said springsteel plate is of a generally trapezoidal configuration.

9. The rail clip for fastening rail to rail ties of claim 7 further comprising screw or spike holes disposed adjacent to each arch of said double arched sine shaped curve.

10. The rail clip for fastening rail to rail ties of claim 9, wherein said total pressure required to flatten said double arched sine shaped curve of said long edge is in the range of about 2,000 to 4,000 pounds.

11. The rail clip for fastening rail to rail ties of claim 10, wherein said double arched sine shaped curve forms a low point at or near the middle of said long edge.

12. The rail clip for fastening rail to rail ties of claim 11, wherein said double arched sine shaped curve terminates in two downwardly projecting ends.

13. The rail clip for fastening rail to rail ties of claim 12, wherein said two downwardly projecting ends project downwardly to a distance lower than said low point at or near the middle of said long edge.

14. A method of mounting rail on a support comprising the steps of disposing a tie plate on a tie, positioning a first resilient member on said tie plate, placing a rail over said tie plate and said first resilient member and securing said rail to said tie with a second resilient member having an arched sine shaped rail biasing edge by flattening said arched sine shaped rail biasing edge against a first rail base by employing a force of about 1,500 pounds to 10,000 pounds which upon train passage dampens high frequency vibrations by resiliently securing said rail base with the ends and center of said arched sine shaped rail biasing edge and which dampens low frequency vibrations by engaging said rail base with said ends of said arched sine shaped rail biasing edge.

15. The method of mounting rail on a support of claim 14, wherein said rail is secured to said tie by employing two second resilient members for each railroad tie to engage both the first and second rail base on each side of said track.

16. The method of mounting a rail on the support of claim 15 wherein said first resilient member is an elastomer pad.

* * * * *